US011587498B2

(12) United States Patent
Chen

(10) Patent No.: US 11,587,498 B2
(45) Date of Patent: Feb. 21, 2023

(54) DRIVING METHOD AND DEVICE FOR LIGHT-EMITTING ELEMENT

(71) Applicant: Shenzhen China Star Optoelectronics Semiconductor Display Technology Co., Ltd., Shenzhen (CN)

(72) Inventor: Shujhih Chen, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/620,929

(22) PCT Filed: Nov. 8, 2019

(86) PCT No.: PCT/CN2019/116595
§ 371 (c)(1),
(2) Date: Dec. 10, 2019

(87) PCT Pub. No.: WO2020/238038
PCT Pub. Date: Dec. 3, 2020

(65) Prior Publication Data

US 2022/0335879 A1 Oct. 20, 2022

(30) Foreign Application Priority Data

May 31, 2019 (CN) ..... 201910468298.1

(51) Int. Cl.
*G09G 3/32* (2016.01)
*G09G 3/20* (2006.01)

(52) U.S. Cl.
CPC ..... *G09G 3/32* (2013.01); *G09G 3/2007* (2013.01); *G09G 2320/0626* (2013.01); *G09G 2320/0686* (2013.01); *G09G 2360/16* (2013.01)

(58) Field of Classification Search
CPC ..... G09G 3/2007; G09G 2360/16; G09G 2320/0626; G09G 2320/0686; G09G 3/32
See application file for complete search history.

(56) References Cited

U.S. PATENT DOCUMENTS

| | | | | |
|---|---|---|---|---|
| 5,748,160 | A | 5/1998 | Shieh et al. | |
| 5,990,629 | A | 11/1999 | Yamada et al. | |
| 2005/0168417 | A1 | 8/2005 | Ha et al. | |
| 2006/0007103 | A1 | 1/2006 | Oh et al. | |
| 2010/0033513 | A1* | 2/2010 | Choi | G09G 3/3611 345/82 |
| 2010/0149167 | A1 | 6/2010 | Hasegawa et al. | |
| 2011/0025732 | A1* | 2/2011 | Wang | G09G 5/10 345/87 |

(Continued)

FOREIGN PATENT DOCUMENTS

| | | | |
|---|---|---|---|
| CN | 1216135 | A | 5/1999 |
| CN | 1658264 | A | 8/2005 |

(Continued)

*Primary Examiner* — Muhammad N Edun
(74) *Attorney, Agent, or Firm* — PV IP PC; Wei Te Chung; Ude Lu

(57) ABSTRACT

The invention discloses a driving method and a device for a light-emitting element. The method includes: acquiring a display image; calculating a backlight brightness required for the display image; and selecting at least one pulse signal from the preset plurality of pulse signals to drive the light emitting element according to the backlight brightness.

10 Claims, 3 Drawing Sheets

(56) References Cited

U.S. PATENT DOCUMENTS

| | | | | |
|---|---|---|---|---|
| 2011/0267377 | A1* | 11/2011 | Kim | G09G 3/3406 345/102 |
| 2015/0103105 | A1* | 4/2015 | Kim | G09G 3/3426 345/102 |
| 2017/0006679 | A1 | 1/2017 | Chin et al. | |

FOREIGN PATENT DOCUMENTS

| | | | |
|---|---|---|---|
| CN | 1702730 | A | 11/2005 |
| CN | 101763820 | A | 6/2010 |
| CN | 103021349 | A | 4/2013 |
| CN | 106332408 | A | 1/2017 |
| CN | 106652963 | A | 5/2017 |
| CN | 107845368 | A | 3/2018 |
| CN | 110264963 | A | 9/2019 |
| EP | 0762374 | A1 | 3/1997 |

* cited by examiner

DRIVING METHOD AND DEVICE FOR LIGHT-EMITTING ELEMENT

FIELD OF INVENTION

The present invention relates to a field of display panel technology, and in particular, to a method and a device for driving a light-emitting element.

DESCRIPTION OF PRIOR ART

The existing display panel generally adopts a pulse width modulation (PWM) technology to control brightness of a backlight, that is, instant brightness obtained by time division continues to be added up to achieve a desired brightness. Specifically, when scan lines are progressively scanned, a high frequency data line signal is used to cause the LED to be quickly turned on and off, and the brightness is added up to an expected display brightness during the scan time. When the scan lines (Gate) are provided with a high level input, a driving device inputs a certain number of same pulses to LEDs through the data lines (Data) to control a number of times of light-emitting of the LEDs to add up the brightness. As shown in FIG. 1, an LED1 between a scan line G1 and a data line D1 lights up once, an LED2 between the scan line G1 and a data line D2 lights up three times, and an LED4 between the scan line G1 and a data line D4 lights up six times, such that when the scan lines (Gate) are provided with a high level input, brightness of LED1 is L1, brightness of LED2 is 3L1, and brightness of LED3 is 6L1. However, if a grayscale value of one frame of image is 256, the driving device needs to input 256 pulses to the corresponding LEDs to add up the brightness, so that a driving efficiency of the driving device is low, and thus a number of driving channels supported by the driving device is fewer.

SUMMARY OF INVENTION

Embodiments of the present invention provide a driving method and a device for a light-emitting element, which can improve driving efficiency and increase a number of driving channels supported by the diving device.

An embodiment of the present invention provides a method of driving a light-emitting element, including: acquiring a display image; calculating a backlight brightness required for the display image; and selecting at least one pulse signal from a plurality of preset pulse signals to drive the light-emitting element according to the backlight brightness.

Further, driving voltages or driving currents of the plurality of preset pulse signals are different Further, the step of selecting at least one pulse signal from a plurality of preset pulse signals to drive the light-emitting element according to the backlight brightness specifically includes: obtaining each brightness corresponding to each of the preset pulse signals by querying a preset brightness relationship table according to the driving voltages or driving currents of each of the preset pulse signals; adding up at least one brightness selected from various brightnesses according to the backlight brightness, and calculating a number of brightness added up required for each selected brightness; and transmitting a corresponding number of the pulse signals to the light-emitting element according to each of the selected brightness and the number of brightness added up, to drive the light-emitting element.

Further, the light-emitting element includes at least one light-emitting diode (LED), and the step of calculating backlight brightness required for the display image specifically includes: dividing the display image into at least one pixel partition, and the at least one pixel partition is in one-to-one correspondence with the at least one LED; obtaining a pixel grayscale value of each pixel partition respectively; and calculating the backlight brightness required for each pixel partition according to the pixel grayscale value respectively.

Further, the step of selecting at least one pulse signal from a plurality of preset pulse signals to drive the light-emitting element according to the backlight brightness specifically includes: selecting at least one pulse signal from the plurality of preset pulse signals to drive the LED corresponding to the pixel partition according to the backlight brightness required for each pixel partition.

An embodiment of the present invention further provides a method of driving a light-emitting element, including: acquiring a display image; calculating a backlight brightness required for the display image; and selecting at least one pulse signal from a plurality of preset pulse signals to drive the light-emitting element according to the backlight brightness.

Further, the step of selecting at least one pulse signal from a plurality of preset pulse signals to drive the light-emitting element according to the backlight brightness specifically includes: obtaining each brightness corresponding to each of the preset pulse signals by querying a preset brightness relationship table according to the driving voltages or driving currents of each of the preset pulse signals; adding up at least one brightness selected from various brightnesses according to the backlight brightness, and calculating a number of brightness added up required for each selected brightness; and transmitting a corresponding number of the pulse signals to the light-emitting element according to each of the selected brightness and the number of brightness added up, to drive the light-emitting element.

Further, the light-emitting element includes at least one light-emitting diode (LED), and the step of calculating backlight brightness required for the display image includes: dividing the display image into at least one pixel partition, and the at least one pixel partition is in one-to-one correspondence with the at least one LED; obtaining a pixel grayscale value of each pixel partition respectively; and calculating the backlight brightness required for each pixel partition according to the pixel grayscale value respectively.

Further, the step of selecting at least one pulse signal from a plurality of preset pulse signals to drive the light-emitting element according to the backlight brightness includes: selecting at least one pulse signal from the plurality of preset pulse signals to drive the LED corresponding to the pixel partition according to the backlight brightness required for each pixel partition.

An embodiment of the present invention further provides a driving device for a light-emitting element, including: a display image acquiring module for acquiring a display image; a backlight brightness calculation module for calculating a backlight brightness required for the display image; and a driving module for selecting at least one pulse signal from a plurality of preset pulse signals to drive the light-emitting element according to the backlight brightness.

Further, driving voltages or driving currents of the plurality of the preset pulse signals are different.

Further, the driving module specifically includes: a query unit configured to obtain each brightness corresponding to each of the preset pulse signals by querying a preset brightness relationship table according to the driving voltages or driving currents of each of the preset pulse signals; a selecting unit configured to add up at least one brightness selected from various brightnesses according to the backlight brightness, and calculating a number of brightness added up required for each selected brightness; and a driving unit configured to transmit a corresponding number of the pulse signals to the light-emitting element according to each of the selected brightness and the number of brightness added up, to drive the light-emitting element.

Further, the light-emitting element includes at least one light-emitting diode (LED), and the backlight brightness calculation module specifically includes: a dividing unit obtaining unit configured to divide the display image into at least one pixel partition corresponding to the at least one LED in one-to-one; a grayscale value obtaining unit configured to obtain a pixel grayscale value of each pixel partition respectively; and a backlight brightness calculation module configured to calculate the backlight brightness required for each pixel partition according to the pixel grayscale value respectively.

Further, the driving module is specifically configured to select at least one pulse signal from the plurality of preset pulse signals to drive the LED corresponding to the pixel partition according to the backlight brightness required for each pixel partition.

Beneficial effects of the present invention are: acquiring a display image; calculating a backlight brightness required for the display image; and selecting at least one pulse signal from a plurality of preset pulse signals to drive the light-emitting element according to the backlight brightness. That is, by selecting different pulse signals to drive the light-emitting element to achieve the backlight brightness, the driving efficiency is effectively improved, the pulse output frequency is reduced, and the number of channels supported is increased.

BRIEF DESCRIPTION OF DRAWINGS

In order to more clearly illustrate the embodiments or the technical solutions of the existing art, the drawings illustrating the embodiments or the existing art will be briefly described below. Obviously, the drawings in the following description merely illustrate some embodiments of the present invention. Other drawings may also be obtained by those skilled in the art according to these figures without paying creative work.

DETAILED DESCRIPTION OF PREFERRED EMBODIMENTS

Figure 1:
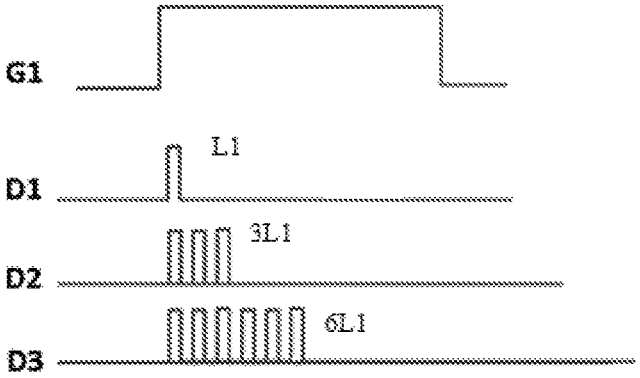
FIG. 1 is a pulse waveform diagram of an LED in the prior art.

The preferred embodiments of the present invention are described below with reference to the accompanying drawings, which are used to exemplify the embodiments of the present invention, which can fully describe the technical contents of the present invention to make the technical content of the present invention clearer and easy to understand. However, the present invention may be embodied in many different forms of embodiments, and the scope of the present invention is not limited to the embodiments set forth herein.

The terms used in the description of the present invention are only used to describe specific embodiments, and it is not intended to show the concept of the invention. Expressions used in the singular encompasses the plural forms of expression unless the context clearly dictates otherwise. in the description of the present invention, it is to be understood that the terms such as "including", "having" and "containing", are intended to be illustrative of the possibilities of the features, the numbers, the steps, the acts, or combinations thereof disclosed in the present disclosure, and it is not intended to exclude the possibility that one or more other features, numbers, steps, acts, or combinations thereof may be added. The same reference numerals in the drawings denote the same parts.

Figure 2:
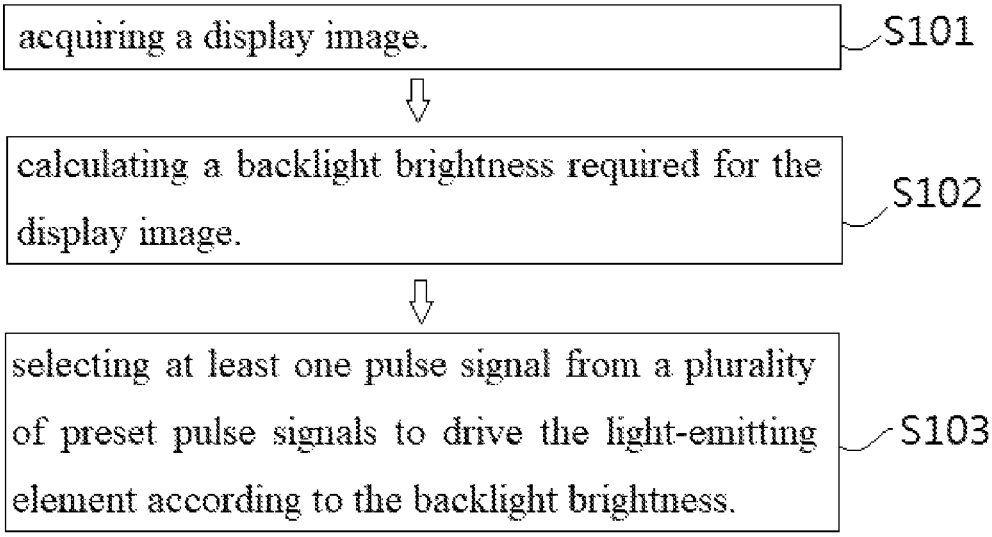
FIG. 2 is a schematic flow chart of a method of driving a light-emitting element according to an embodiment of the present invention.

FIG. 2 is a schematic flow chart of a method of driving a light-emitting element according to an embodiment of the present invention.

As shown in FIG. 2, the method of driving the light-emitting element provided by this embodiment includes:

101. Acquiring a display image.

102. Calculating a backlight brightness required for the display image.

In this embodiment, the greater the brightness of the display image, the greater the backlight brightness required. The backlight brightness required for the display image can be obtained by calculation according to the pixel grayscale value.

The backlight brightness is the brightness of the backlight source, and the backlight source is composed of a light-emitting element, and the light-emitting element includes at least one LED, that is, the backlight source in this embodiment is an LED backlight. The backlight source can be divided into at least one backlight partition, and the at least one pixel partition is in one-to-one correspondence with the at least one LED. The display image may be divided into at least one pixel partition in one-to-one correspondence with the at least one backlight partition, and the backlight brightness of each backlight partition is determined by the grayscale value of its corresponding pixel partition.

Specifically, the step 102 includes: dividing the display image into at least one pixel partition, and the at least one pixel partition is in one-to-one correspondence with the at least one LED; obtaining a pixel grayscale value of each pixel partition respectively; and calculating the backlight brightness required for each pixel partition according to the pixel grayscale value respectively.

It should be noted that, when calculating the backlight brightness required for each pixel partition, the required backlight brightness may be determined according to the grayscale average value of all the pixels in each pixel partition, or according to the grayscale weighted value of the pixels in each pixel partition. Alternatively, the required backlight brightness may be determined according to the grayscale maximum values of the red, green and blue sub-pixels in each pixel partition. For example, the correspondence between the pixel grayscale value of the pixel partition and its required backlight brightness can be as shown in Table 1.

TABLE 1

| pixel grayscale value | backlight brightness (gamma = 2.2) |
|---|---|
| 32 | 10.40 |
| 64 | 47.78 |
| 128 | 219.52 |
| 196 | 560.50 |
| 255 | 1000.00 |

103. selecting at least one pulse signal from a plurality of preset pulse signals to drive the light-emitting element according to the backlight brightness.

In this embodiment, the driving voltages or driving currents of the plurality of preset pulse signals are different. One or more pulse signals are selected according to the required backlight brightness, and at least one pulse corresponding to the selected pulse signal is sent to the light-emitting elements according to the selected pulse signal, to drive the light-emitting element to emit light. Different pulse signals drive the light-emitting elements to have different display brightness, and the brightness of the light-emitting elements driven by different pulse signals are added up to obtain the desired backlight brightness.

Specifically, the step 103 includes: selecting at least one from the plurality of preset pulse signals to drive the LED corresponding to the pixel partition according to the backlight brightness required for each pixel partition.

Figure 3:
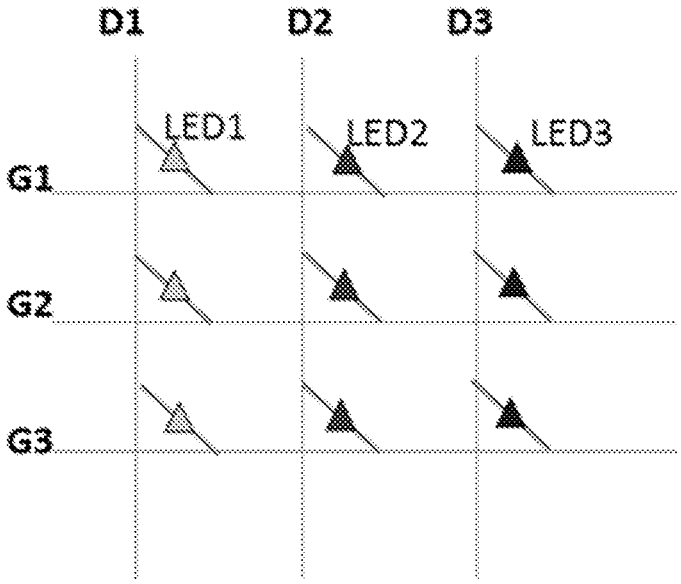
FIG. 3 is a schematic diagram of distribution of LEDs in a method of driving a light-emitting element according to an embodiment of the present invention.

In this embodiment, as shown in FIG. 3, the light-emitting element corresponds to a plurality of scan lines and a plurality of data lines, wherein the LEDs in the light-emitting element are arranged in an array, and the LEDs of each row correspond to a scan line, and the LEDs of each column corresponds to a data line. For example, LED1 corresponds to the data line D1 and the scan line G1; LED2 corresponds to the data line D2 and the scan line G1; and LED3 corresponds to the data line D3 and the scan line G1.

Each LED corresponds to a pixel partition, and after acquiring the backlight brightness required for the pixel partition corresponding to each LED, the pulse signal is selected according to the backlight brightness to input at least one corresponding pulse to the corresponding LED according to the selected pulse signal. When the scan lines are progressively scanned, the LED corresponding to the scan line is inputted with at least one corresponding pulse, that is, at least one corresponding pulse is inputted to the corresponding data line of the LED to drive the LED by using the selected pulse signal, LED The brightness added up by the pulse drive is the desired backlight brightness.

In one embodiment, the step 103 includes: obtaining each brightness corresponding to each of the preset pulse signals by querying a preset brightness relationship table according to the driving voltages or driving currents of each of the preset pulse signals; adding up at least one brightness selected from various brightnesses according to the backlight brightness, and calculating a number of brightness added up required for each selected brightness; and transmitting a corresponding number of the pulse signals to the light-emitting element according to each of the selected brightness and the number of brightness added up, to drive the light-emitting element.

Figure 4:
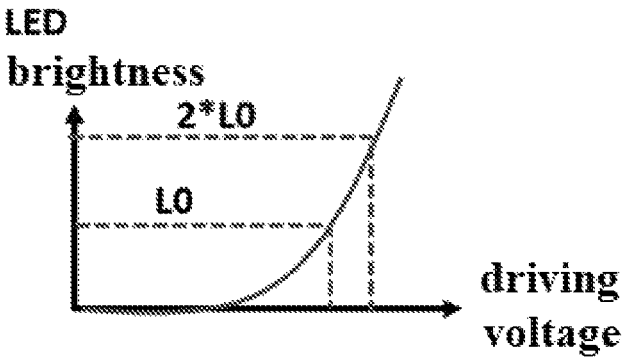
FIG. 4 is a curve relationship graph between brightness and driving voltage in a method of driving a light-emitting element according to an embodiment of the present invention.

It should be noted that the preset brightness relationship table may be a correspondence table between the brightness and the driving voltage, or a correspondence table between the brightness and the driving current. For example, the brightness relationship table can be obtained according to a light-current-voltage (LIV) curve of the LED, wherein the curve relationship graph between brightness and driving voltage is shown in FIG. 4, and the LIV curves of different types of LEDs are different, that is, the relationships between display brightness and corresponding driving voltage are different.

First, each brightness corresponding to each of the preset pulse signals is obtained by querying a preset brightness relationship table according to the driving voltages or driving currents of each of the preset pulse signals. Then, the pulse signal is selected according to the required backlight brightness, and the number of pulses is calculated, wherein the driving voltages or driving currents of different pulse signals are different, and the numbers of different pulse signals are also different. For example, the preset pulse signal includes a pulse signal having a driving voltage of 4V and a pulse signal having a driving voltage of 5V. The query shows that the display brightness corresponding to the 4V pulse signal is L0, and the display brightness corresponding to the 5V pulse signal is 2L0.

Figure 5:
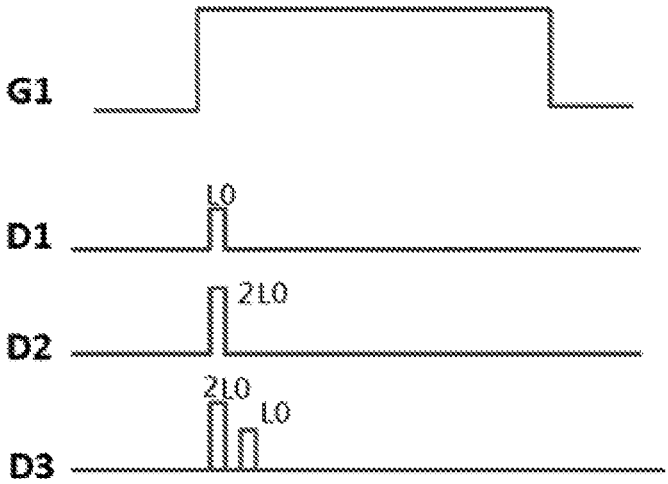
FIG. 5 is a pulse waveform diagram of an LED in a method of driving a light-emitting element according to an embodiment of the present invention.

Further, the display brightness is selected according to the backlight brightness required for each pixel partition, and the number of backlight brightness required for the display brightness is calculated to input corresponding pulse to the corresponding LED. For example, as shown in FIG. 3 and FIG. 5, when the backlight brightness required for the pixel partition corresponding to the LED1 is L0, the pulse signal with the brightness of L0 is selected, that is, a 4V pulse signal is selected, and the number of pulses is 1. During the scanning line G1 is provided with a high level input, the data line D1 of LED1 inputs one 4V pulse signal, so that the brightness of the LED driven by one 4V pulse signal is L0. When the backlight brightness required for the pixel partition corresponding to LED2 is 2L0, the pulse signal with the display brightness of 2L0 is selected, that is, a 5V pulse signal is selected, and the number of pulses is 1. During the scanning line G1 is provided with a high level input, the data line D2 of LED2 inputs one 5V pulse signal, so that the brightness of the LED driven by one 5V pulse signal is 2L0. When the backlight brightness required for the pixel partition corresponding to LED3 is 3L0, the pulse signal with the display brightness of L0 and the pulse signal with the display brightness of 2L0 are selected, that is, a 4V pulse signal and a 5V pulse signal are selected. During the scanning line G1 is provided with a high level input, the data line D3 of LED3 inputs one 4V pulse signal and one 5V pulse signal, so that the sum of brightness of the LED sequentially driven by one 4V pulse signal and one 5V pulse signal is 3L0. Compared with the prior art using two identical pulse driving LEDs 2 and three identical pulses to drive the LEDs 3, this embodiment improves the driving efficiency, reduces the pulse output frequency, and increases the number of driving channels supported.

It can be seen from the above that the method of driving the light-emitting element provided by the embodiment can acquire a display image; calculate a backlight brightness required for the display image; and select at least one pulse signal from a plurality of preset pulse signals to drive the light-emitting element according to the backlight brightness. That is, by selecting different pulse signals to drive the light-emitting element to achieve the backlight brightness, the driving efficiency is effectively improved, the pulse output frequency is reduced, and the number of channels supported is increased.

Correspondingly, an embodiment of the present invention further provides a driving device for a light-emitting element, which can implement all the processes in the above embodiments. The driving device in this embodiment can be integrated in a pulse width modulation (PWM) driving chip.

Figure 6:
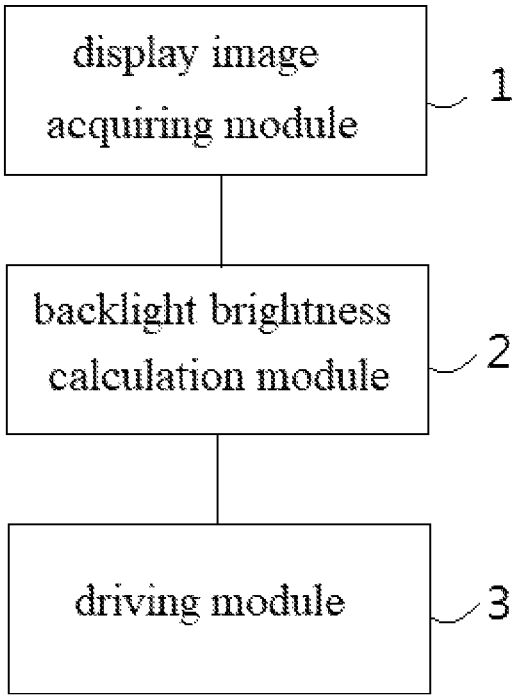
FIG. 6 is a schematic structural diagram of a driving device for a light-emitting element according to an embodiment of the present invention.

As shown in FIG. 6, the driving device for the light-emitting element provided by this embodiment specifically includes: a display image acquiring module for acquiring a display image; a backlight brightness calculation module for calculating a backlight brightness required for the display image; and a driving module for selecting at least one pulse signal from a plurality of preset pulse signals to drive the light-emitting element according to the backlight brightness.

Further, driving voltages or driving currents of the plurality of the preset pulse signals are different.

Further, the driving module specifically includes: a query unit configured to obtain each brightness corresponding to each of the preset pulse signals by querying a preset brightness relationship table according to the driving voltages or driving currents of each of the preset pulse signals; a selecting unit configured to add up at least one brightness selected from various brightnesses according to the backlight brightness, and calculating a number of brightness added up required for each selected brightness; and a driving unit configured to transmit a corresponding number of the pulse signals to the light-emitting element according to each of the selected brightness and the number of brightness added up, to drive the light-emitting element.

Further, the light-emitting element includes at least one light-emitting diode (LED), and the backlight brightness calculation module specifically includes: a dividing unit obtaining unit configured to divide the display image into at least one pixel partition corresponding to the at least one LED in one-to-one; a grayscale value obtaining unit configured to obtain a pixel grayscale value of each pixel partition respectively; and a backlight brightness calculation module configured to calculate the backlight brightness required for each pixel partition according to the pixel grayscale value respectively.

Further, the driving module is specifically configured to select at least one pulse signal from the plurality of preset pulse signals to drive the LED corresponding to the pixel partition according to the backlight brightness required for each pixel partition.

It can be seen from the above that the driving device for the light-emitting element provided by the embodiment can acquire a display image; calculate a backlight brightness required for the display image; and select at least one pulse signal from a plurality of preset pulse signals to drive the light-emitting element according to the backlight brightness. That is, by selecting different pulse signals to drive the light-emitting element to achieve the backlight brightness, the driving efficiency is effectively improved, the pulse output frequency is reduced, and the number of channels supported is increased.

While the invention has been described by way of example and in terms of the preferred embodiments, it is to be understood that the invention is not limited to the disclosed embodiments. To the contrary, it is intended to cover various modifications and similar arrangements. Therefore, the scope of the appended claims should be accorded the broadest interpretation so as to encompass all such modifications and similar arrangements.

What is claimed is:

1. A method of driving a light-emitting element, comprising:

acquiring a display image;

calculating a backlight brightness required for the display image; and selecting at least one pulse signal from a plurality of preset pulse signals to drive the light-emitting element according to the backlight brightness, wherein driving voltages or driving currents of the plurality of preset pulse signals are different; and wherein the step of selecting at least one pulse signal from a plurality of preset pulse signals to drive the light-emitting element according to the backlight brightness comprises:

obtaining each brightness corresponding to each of the preset pulse signals by querying a preset brightness relationship table according to the driving voltages or driving currents of each of the preset pulse signals;

adding up at least one brightness selected from various brightnesses according to the backlight brightness, and calculating a number of brightness added up required for each selected brightness; and transmitting a corresponding number of the pulse signals to the light-emitting element according to each of the selected brightness and the number of brightness added up, to drive the light-emitting element.

2. The method of driving the light-emitting element according to claim 1, wherein the light-emitting element comprises at least one light-emitting diode (LED), and the step of calculating backlight brightness required for the display image comprises:

dividing the display image into at least one pixel partition, and the at least one pixel partition is in one-to-one correspondence with the at least one LED;

obtaining a pixel grayscale value of each pixel partition respectively; and calculating the backlight brightness required for each pixel partition according to the pixel grayscale value respectively.

3. The method of driving the light-emitting element according to claim 2, wherein the step of selecting at least one pulse signal from a plurality of preset pulse signals to drive the light-emitting element according to the backlight brightness comprises:

selecting at least one pulse signal from the plurality of preset pulse signals to drive the LED corresponding to the pixel partition according to the backlight brightness required for each pixel partition.

4. A method of driving a light-emitting element, comprising:

acquiring a display image;

calculating a backlight brightness required for the display image; and selecting at least one pulse signal from a plurality of preset pulse signals to drive the light-emitting element according to the backlight brightness, wherein the step of selecting at least one pulse signal from a plurality of preset pulse signals to drive the light-emitting element according to the backlight brightness comprises:

obtaining each brightness corresponding to each of the preset pulse signals by querying a preset brightness relationship table according to the driving voltages or driving currents of each of the preset pulse signals;

adding up at least one brightness selected from various brightnesses according to the backlight brightness, and calculating a number of brightness added up required for each selected brightness; and transmitting a corresponding number of the pulse signals to the light-emitting element according to each of the selected brightness and the number of brightness added up, to drive the light-emitting element.

5. The method of driving the light-emitting element according to claim 4, wherein the light-emitting element comprises at least one light-emitting diode (LED), and the step of calculating backlight brightness required for the display image comprises:

dividing the display image into at least one pixel partition, and the at least one pixel partition is in one-to-one correspondence with the at least one LED;

obtaining a pixel grayscale value of each pixel partition respectively; and calculating the backlight brightness required for each pixel partition according to the pixel grayscale value respectively.

6. The method of driving the light-emitting element according to claim 5, wherein the step of selecting at least one pulse signal from a plurality of preset pulse signals to drive the light-emitting element according to the backlight brightness comprises:

selecting at least one from the plurality of preset pulse signals to drive the LED corresponding to the pixel partition according to the backlight brightness required for each pixel partition.

7. A driving device for a light-emitting element, comprising:

a display image acquiring module for acquiring a display image;

a backlight brightness calculation module for calculating a backlight brightness required for the display image; and a driving module for selecting at least one pulse signal from a plurality of preset pulse signals to drive the light-emitting element according to the backlight brightness, wherein the light-emitting element comprises at least one light-emitting diode (LED), and the backlight brightness calculation module comprises:

a dividing unit obtaining unit configured to divide the display image into at least one pixel partition corresponding to the at least one LED in one-to-one;

a grayscale value obtaining unit configured to obtain a pixel grayscale value of each pixel partition respectively; and a backlight brightness calculation module configured to calculate the backlight brightness required for each pixel partition according to the pixel grayscale value respectively.

8. The driving device for the light-emitting element according to claim 7, wherein driving voltages or driving currents of the plurality of the preset pulse signals are different.

9. The driving device for the light-emitting element according to claim 8, wherein the driving module comprises:

a query unit configured to obtain each brightness corresponding to each of the preset pulse signals by querying a preset brightness relationship table according to the driving voltages or driving currents of each of the preset pulse signals;

a selecting unit configured to add up at least one brightness selected from various brightnesses according to the backlight brightness, and calculating a number of brightness added up required for each selected brightness; and a driving unit configured to transmit a corresponding number of the pulse signals to the light-emitting element according to each of the selected brightness and the number of brightness added up, to drive the light-emitting element.

10. The driving device for the light-emitting element according to claim 7, wherein the driving module is configured to:

select at least one pulse signal from the plurality of preset pulse signals to drive the LED corresponding to the pixel partition according to the backlight brightness required for each pixel partition.

* * * * *